US005440317A

United States Patent [19]

Jalloul et al.

[11] Patent Number: 5,440,317

[45] Date of Patent: Aug. 8, 1995

[54] ANTENNA ASSEMBLY FOR A PORTABLE TRANSCEIVER

[75] Inventors: Amer Jalloul, East Brunswick; John S. Mayo, Chatham, both of N.J.

[73] Assignee: AT&T Corp., Murray Hill, N.J.

[21] Appl. No.: 61,937

[22] Filed: May 17, 1993

[51] Int. Cl.[6] ..... H01Q 1/24; H01Q 9/16

[52] U.S. Cl. ..... 343/791; 343/792; 343/702

[58] Field of Search ..... 343/791, 790, 792, 702, 343/900, 901, 903, 906; H01Q 1/24, 9/04, 9/16

[56] References Cited

U.S. PATENT DOCUMENTS

| | | | |
|---|---|---|---|
| 2,486,597 | 11/1949 | Greene | 343/791 |
| 3,656,167 | 4/1972 | Lea | 343/793 |
| 4,647,941 | 3/1987 | Myer | 343/792 |
| 4,658,260 | 4/1987 | Myer | 343/792 |
| 4,989,012 | 1/1991 | Martensson et al. | 343/702 |
| 5,181,043 | 1/1993 | Cooper | 343/713 |

FOREIGN PATENT DOCUMENTS

| | | | |
|---|---|---|---|
| 2-302101 | 12/1990 | Japan | H01Q 1/24 |
| 2-306703 | 12/1990 | Japan | H01Q 1/24 |
| 4-123503 | 4/1992 | Japan | H01Q 1/24 |

OTHER PUBLICATIONS

H. E. King and J. L. Wong "Effects of a Human Body on a Dipole Antenna at 450 and 900 MHz", May 1976, pp. 376–379.

*Primary Examiner*—Donald Hajec
*Assistant Examiner*—Hoanganh Le
*Attorney, Agent, or Firm*—Steven R. Bartholomew; Samuel R. Williamson

[57] ABSTRACT

An antenna assembly for use with a portable transceiver provides improved communication between the portable transceiver and a base station. A novel antenna assembly is created wherein the radiating portion is elevated above the handset by combining a half wavelength sleeve dipole antenna with a coaxial line section followed by a quarter wavelength choke. Such a configuration reduces the antenna-housing interaction. The quarter wavelength choke prevents the coaxial transmission line from radiating RF energy, and therefore limits the radiation to the sleeve dipole portion of the antenna assembly.

9 Claims, 10 Drawing Sheets

FIG. 10
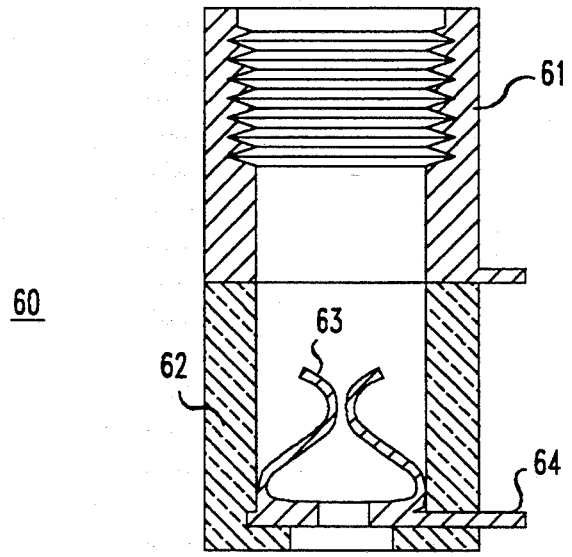
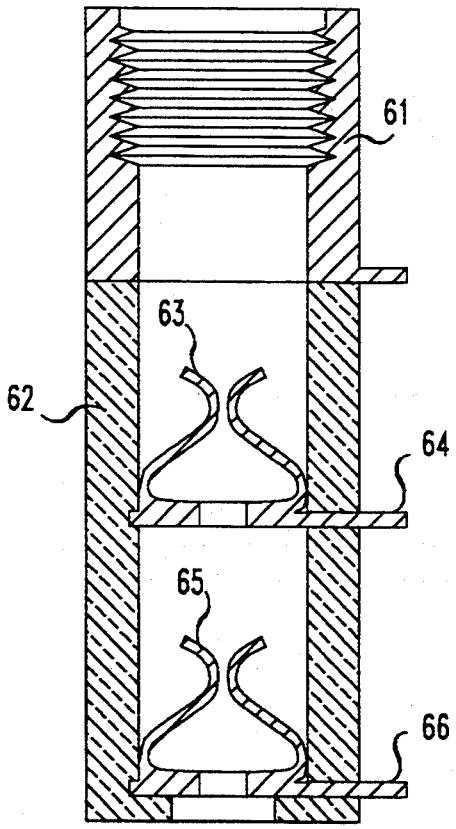
FIG. 11

FIG. 14
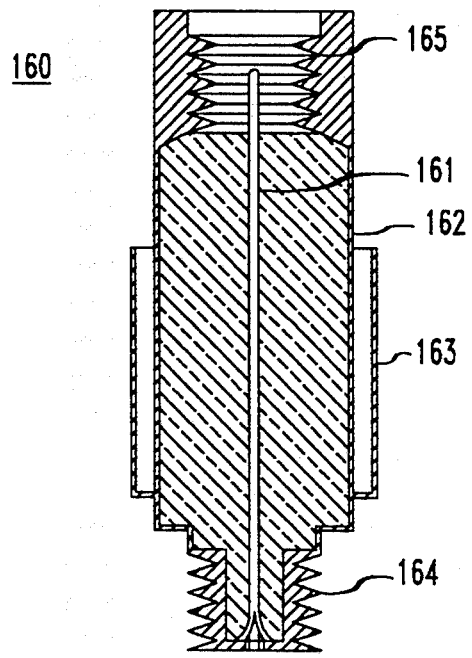
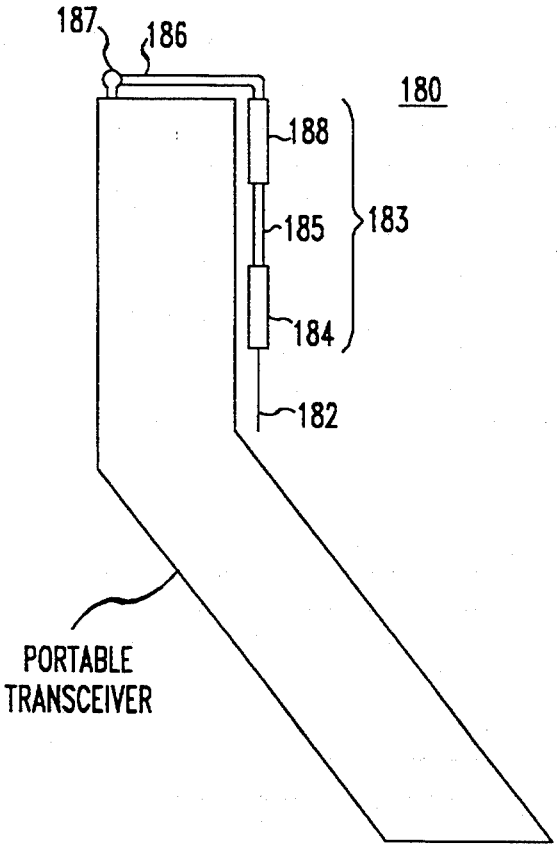
FIG. 15

ANTENNA ASSEMBLY FOR A PORTABLE TRANSCEIVER

BACKGROUND OF THE INVENTION

1. Technical Field

This invention relates to antenna assemblies and, more particularly, to an antenna assembly that provides improved performance for portable transceiver applications.

2. Description of the Prior Art

In cellular telephony there are transceivers that are carried on vehicles such as cars and planes, and there are transceivers that are hand-carried. Of course, the need for reliable communication exists with both types of equipment and the challenge, in particular, is to ensure that reliable communication can take place in cellular networks even at the boundaries of cells.

Efforts directed at improving communications in mobile telephones have previously been undertaken. By way of example, U.S. Pat. No. 5,181,043, which issued to G. N. Cooper on Jan. 19, 1993, describes an arrangement having a passive repeater for cellular telephones. In particular, this arrangement has an antenna which is attached to the window of an automobile and serves as a passive repeater for reradiating a radio transmission received from a portable telephone within the automobile to a cell site within a cellular system. Also, in U.S. Pat. No. 4,989,012 which issued to N. E. Martensson et al. on Jan. 29, 1991, signal transmission and reception in an automobile is improved through use of an antenna assembly which permits operation of a portable telephone either with an antenna attached to the portable telephone or an external antenna attached to the automobile. As described in the Martensson et al. patent, the second external antenna attaches to the portable telephone through a coaxial transmission line.

Although both of the above-described arrangements provide for improved communications for a portable telephone, both arrangements also require additional hardware in the form of additional antennas to achieve the desired improvement. Moreover, these arrangements are intended for use in, and with, automobiles to which the external antennas are necessarily attached.

A typical hand-held portable transceiver has additional constraints. For example, the permitted radiated power level of a portable telephone is only 0.6 watts, so efficient radiation of this power is essential. Yet, cumbersome antenna arrangements are not well tolerated by the user. The need exists, therefore, to do as well as possible with minimum antenna configurations.

SUMMARY OF THE INVENTION

A novel antenna assembly is created, in accordance with the principles of this invention, by combining a half wavelength sleeve dipole antenna with a coaxial line section and a quarter wavelength choke.

In one illustrative embodiment of the invention, a coaxial line of arbitrary length is employed to feed the antenna assembly. In another illustrative embodiment the antenna assembly is collapsible and, in yet another embodiment, means are included to allow activation of a switch to prevent transmission out of the antenna when the antenna is in a collapsed state.

BRIEF DESCRIPTION OF THE DRAWING

FIG. 10 illustrates a transceiver connector suitable for accepting the FIG. 6 antenna;

FIG. 11 illustrates a transceiver connector suitable for accepting the FIG. 9 antenna, including means for detecting the antenna's collapsed state;

FIG. 14 is a cross-section illustration of a antenna extender arranged in accordance with the principles of this invention;

FIG. 15 depicts an arrangement that allows an antenna to be rotated about a point in close proximity of the transceiver to which the antenna is connected.

DETAILED DESCRIPTION

Figure 1:
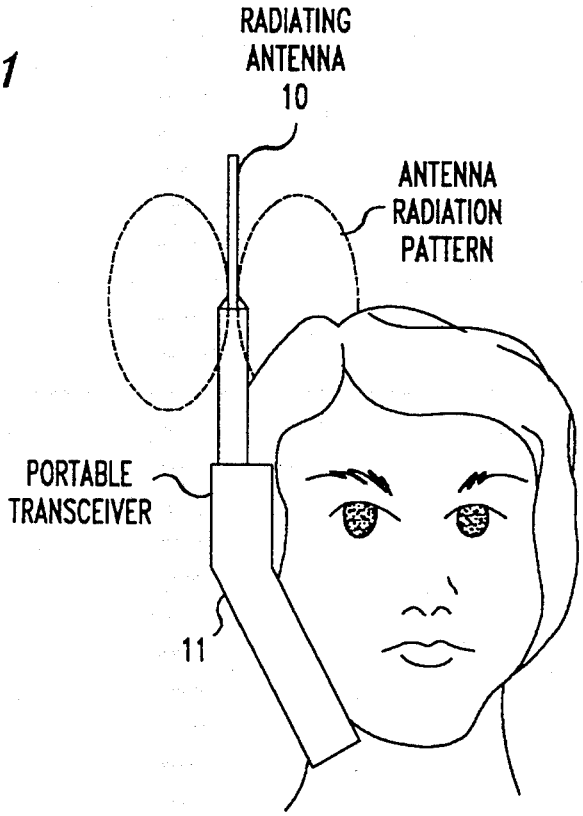
FIG. 1 PRIOR ART
FIGS. 1 and 2 present a prior art arrangement showing a conventional sleeve dipole radiating antenna attached directly to a portable transceiver.

FIG. 1 depicts a prior art arrangement wherein a conventional sleeve dipole radiating antenna 10 is attached directly to a portable transceiver 11 such as a cellular telephone. In such an arrangement a person's body and the transceiver's housing combine to degrade the antenna's performance. While it is somewhat possible to account for the transceiver's housing, the body effect remains quite unpredictable and varies from one person to another. A person's body degrades the antenna's performance on two accounts: it increases the mismatch between the feed point and the antenna and thereby reduces the radiated energy, and it blocks some of the radiated energy. Of course, when the person's body is located between the associated base station's antenna and the portable transceiver antenna 10 the partial blockage may affect the communication.

Figure 2:
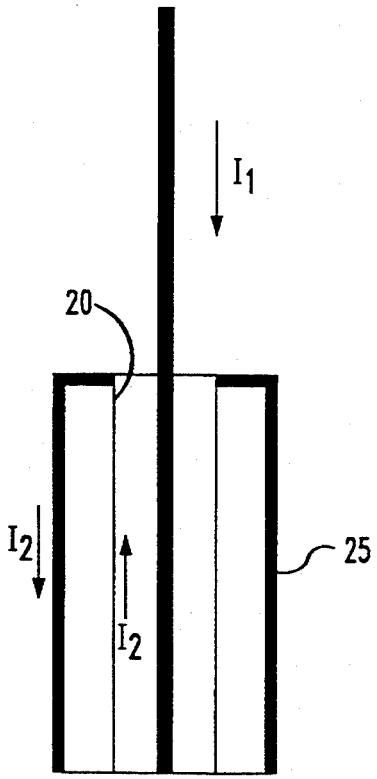
FIG. 2 PRIOR ART

FIG. 2 illustrates the cross-sectional view of the sleeve dipole antenna of FIG. 1. Current $I_1$ flows downward (at some instant) through center conductor 10 that extends one quarter wavelength above the top of a sleeve that extends downward one quarter wave length. At that time, the return current $I_2$ flows upwards across the inner surface of sheathing 20. When $I_2$ reaches the top, it continues to flow across the outer surface of sleeve 25. The bottom tip of sleeve 25 presents an infinite impedance to current $I_2$. Since current $I_1$ equals current $I_2$, what appears externally to the antenna, is a center feed of a current (equal to $I_1$) on two quarter wave conductors. Ergo, a half wave dipole antenna.

To overcome deficiencies in the prior art, in accordance with the principles of this invention, a portable antenna arrangement is created (for example, for a hand-held portable transceiver) of unitary construction that includes a non-radiating segment.

Figure 3:
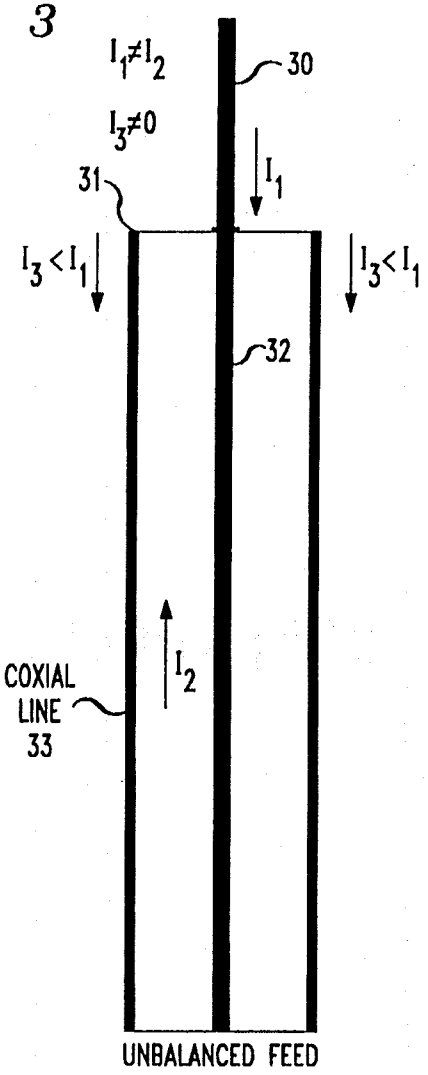
FIG. 3 is a cross-section illustration of a quarter wavelength monopole.

Typically, it is thought by artisans that a coaxial line is non-radiating simply because it includes a shield. That is correct, but only when the line is properly terminated. FIG. 3 depicts the situation (in cross-sectional view) where an antenna is extended by connecting antenna conductor 30 to a coaxial element comprising an inner conductor 32 (connected to conductor 30) and an outer conductor 33. Current $I_1$ which flows in antenna 30 also flows through conductor 32 (flowing downward in FIG. 3). Corresponding thereto, current $I_2$ flows upwards within the inner surface of the coaxial element's outer conductor 33. The impedance presented at point 31 of outer conductor 33 is not infinite and, therefore, a portion of current $I_2$ flows downward on the outside surface of outer conductor 33. Current $I_2$ is not equal to current $I_3$, current $I_3$ is not zero and, consequently, the coaxial element radiates.

Figure 4:
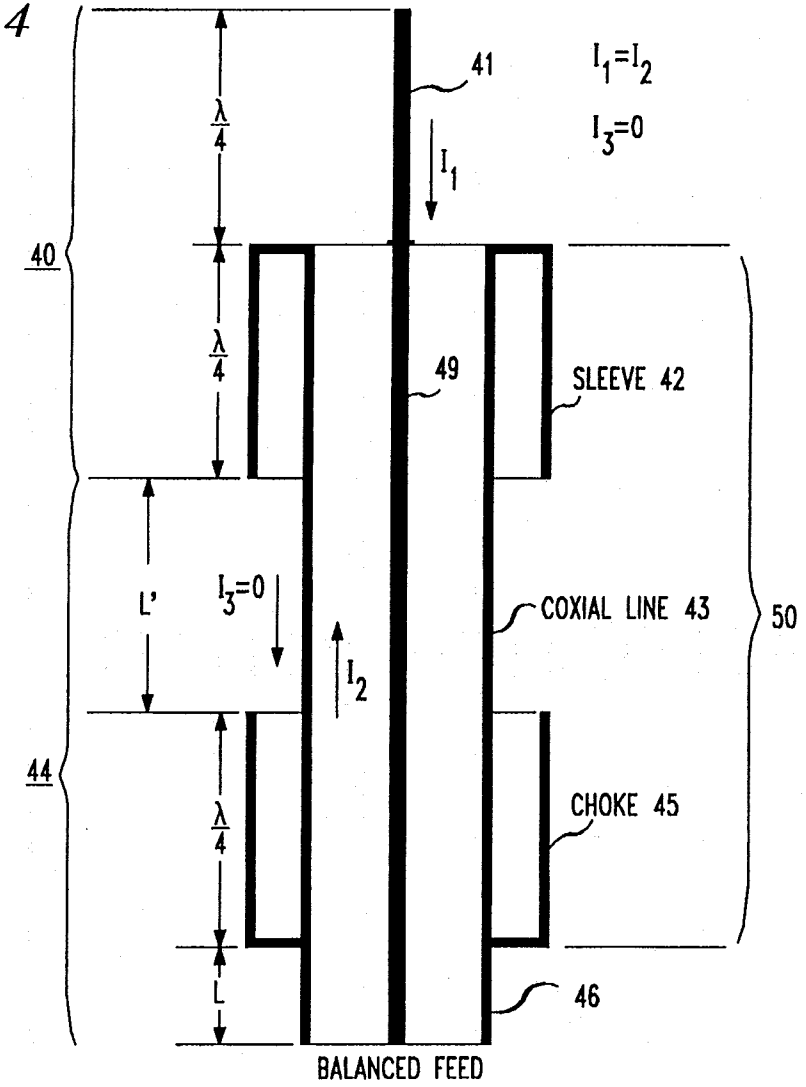
FIG. 4 is a cross-section illustration of a half-wavelength sleeve dipole antenna in accordance with the principles of this invention.

FIG. 4 depicts an antenna design in conformance with the principles of this invention. It comprises a first antenna element 41 that is connected to an inner conductor 49 of a coaxial element 50. Element 41 is nominally $\lambda/4$ long. At the top of element 50 (in the neighborhood of the junction between elements 41 and 49), there is a sleeve 42 that is also nominally $\lambda/4$ long. In accordance with prior an principles, it is known that element 41 and sleeve 42 combine to form a half-wave sleeve dipole antenna. Below sleeve 42 there is a coaxial line portion 43 having a length L' that is sufficiently long to minimize coupling between sleeve element 42 and choke element 45. Below that is a choke element 45 that is $\lambda/4$ long as well. Choke 45 insures that the current at the outer surface of the outer conductor of coaxial line portion 43 is zero. This forces current $I_2$ to be equal to current $I_1$, making coaxial element 50 be properly terminated. Since coaxial element 50 is properly terminated, an additional coaxial segment 46, of any length L, can be added. The result is a radiating portion 40 and a non-radiating portion 44 in a single unitary assembly.

Figure 5:
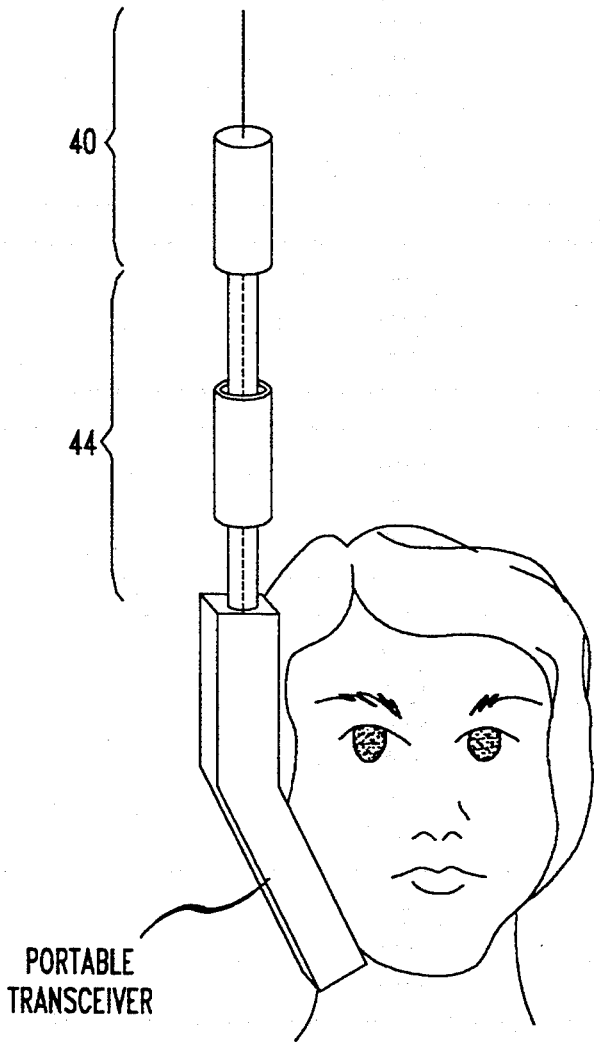
FIG. 5 shows a diagrammatic view of the FIG. 4 antenna attached to a hand-held transceiver.

FIG. 5 presents a more pictorial representation of an antenna comporting with the principles of this invention. As depicted in FIG. 5, it is clear that the radiating portion is removed from a person's head, resulting in a more efficient operation of the antenna. See "Effects of a Human Body on a Dipole Antenna at 450 and 900 MHz", King et al., IEEE Transactions on Antennas and Propagation, May, 1977, pp 376–379.

For best operation, the lengths depicted in FIG. 4 should be modified in accordance with the exact conditions anticipated in a physical embodiment of the FIG. 4 apparatus. Specifically, one should account for the fact that radiation is in air and not in free space; that the transceiver's body (which is shielded and which, therefore, forms a partial ground plane) is proximate to the antenna; and that the space between conductor 49 and the outer conductor of coaxial segment 50 is filled with a dielectric (not explicitly shown in many of the FIGS. in order to improve clarity). All of those considerations tend to reduce the required lengths. Still, the length shown in FIG. 4 is nominally a full wavelength and users may desire shorter structures, particularly at times when the transceiver is not being actively used.

Figure 6:
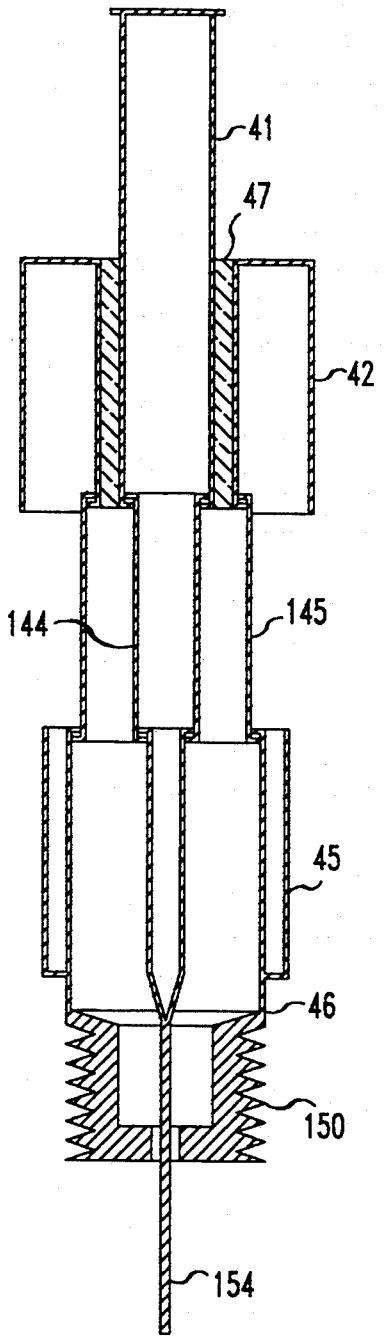
FIG. 6 presents a collapsible antenna embodiment that comports with the principles of this invention.
Figure 7:
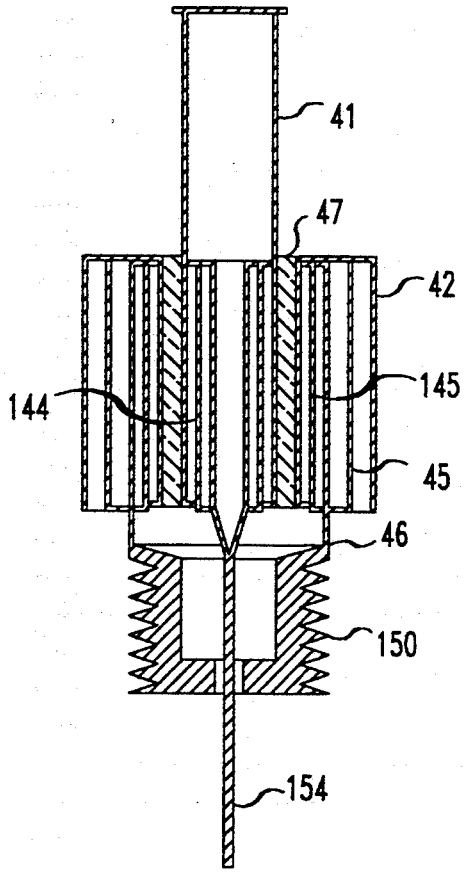
FIG. 7 depicts the FIG. 6 antenna in collapsed form.
Figure 8:
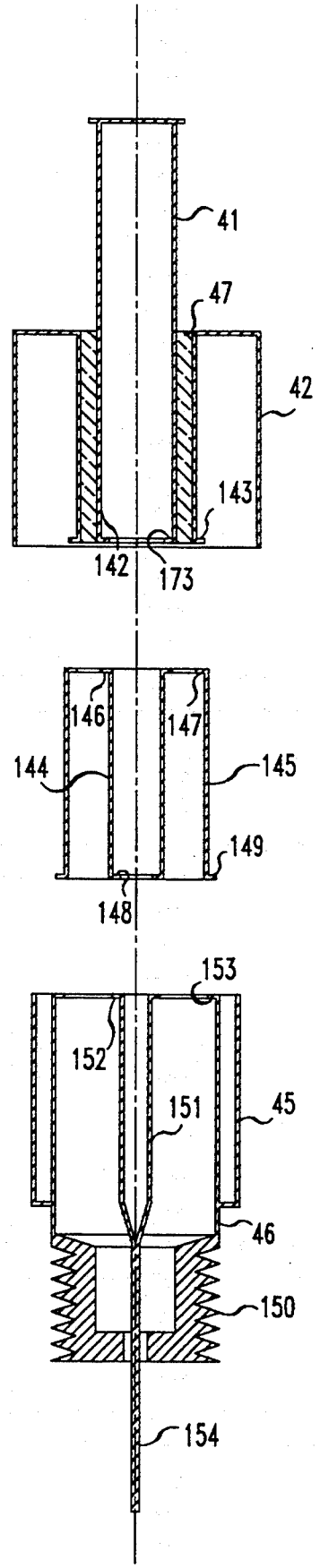
FIG. 8 presents an exploded view of the FIG. 6 antenna.

Collapsible antennas are well known but those are single conductor, monopole type, antennas. FIGS. 6–9 present completely novel designs for a two-conductor collapsible antenna. FIG. 6 presents one antenna design in its extended form, FIG. 7 presents the FIG. 6 antenna in its collapsed form, and FIG. 8 presents an exploded view to assist in understanding the structure.

The collapsible antenna of FIG. 6 comprises a top element that includes sleeve 42 (the reference numbers are found in FIG. 8), conductor 41, a portion of conductor 49 (element 142), and a dielectric portion 47. These elements form a unitary block. Also included in the top element is a lip 143 at the bottom of inner circumference of sleeve 42 and a lip 173 at the bottom of element 142.

The middle element comprises two tubular elements: an inner element 144 that fits slidably (friction fit) within element 142, and an outer element 145 that fits slidably (friction fit) outside lip 143. Elements 144 and 145 also include lip portions (146 and 147, respectively) that are adapted to engage with lips 173 and 143, respectively. At the bottom of elements 144 and 145 there is another set of lips (148 and 149, respectively).

The bottom element of the collapsible antenna comprises choke 45, whatever coaxial length 46 is desired, and a coupling or attaching means. In FIG. 6, the coupling means comprises a male-threaded element 150 with a center hole. These elements (45,46, and 150) form the outer portion of the bottom element of the collapsible antenna. The inner portion of the bottom element of the collapsible antenna comprises the remainder of inner conductor 49 (element 151), a corresponding inner conductor portion of coaxial length 46 and an inner conductor portion of the coupling means, 154. Choke 45 and element 151 include lips 152 and 153 that slidably engage with lips (friction fit) 148 and 149, respectively. Element 154 protrudes out of the hole within element 150.

The above-described lips maintain the top, middle and bottom elements of the collapsible antenna together, regardless of whether the antenna is in its extended or collapsed form. As an aside, the lips shown in FIGS. 6–9 are exaggerated in size in order to make the drawing clearer. Also exaggerated are the widths of the inner conductors shown in FIG. 6–9. It should be noted that it is important for changes in widths of the inner conductors to be small relative to the wavelength of interest, so that the impedance of the coaxial portion (50) remain as uniform as possible. Furthermore, the openings of sleeve 42 and choke 45 should also be small, relative to the wavelength of interest.

It may be observed that the collapsed antenna depicted in FIG. 7 is essentially identical to the prior art antenna of FIG. 2, in the sense that it forms a sleeve dipole antenna. The antenna of FIG. 7 is perfectly operational and, therefore, it is possible to offer users a portable transceiver which operates with an antenna that is operational in the collapsed form (but with a somewhat diminished level of efficiency) and is also operational in an extended form (at full efficiency).

Figure 9:
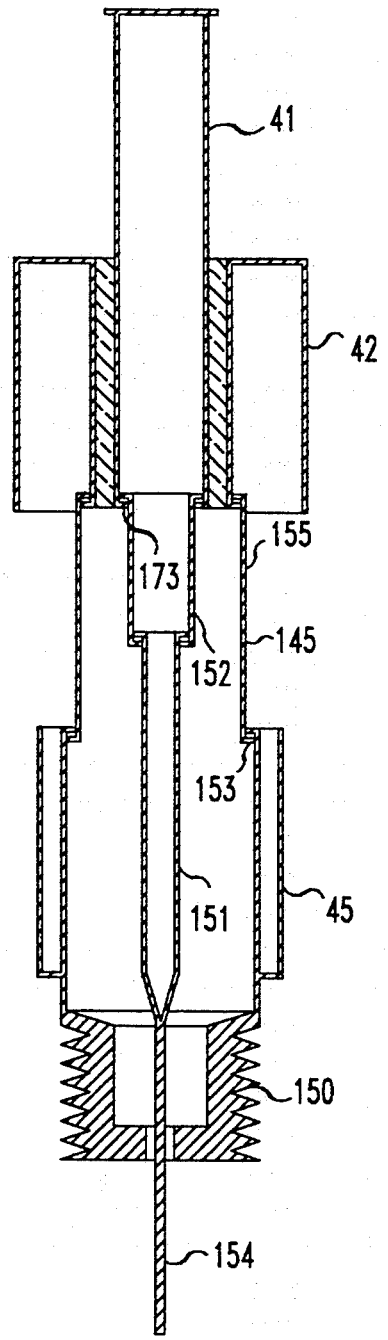
FIG. 9 shows another collapsible antenna embodiment that comports with the principles of this invention.

FIG. 9 depicts a variation on FIG. 6 where the inner conductor is composed of four elements rather than three, allowing the antenna to be collapsed even further. FIG. 9 also includes a longer element 154 that protrudes out of the hole in coupling element 150. Moreover, FIG. 9 depicts the antenna in its extended form. When it is collapsed by pressing on the top of conductor 41, the conductor slides downward and presses against tubular section 155 and lip 173. Further downward movement of element 41 causes element 155 and sleeve 42 (via the force transmitted by lip 173) to slide downward until the shoulder of sleeve 42 engages outer tubular conductor 145. Still further downward movement of element 41 eventually causes the top of element 41 to touch lip 152 of element 151 and push element 154 (and its element 154 extension) downward.

The movement of element 154 as the antenna is being collapsed may be used to control the transmitter section of the transceiver; e.g., to turn it "on" only when the antenna is extended. This ability is described more fully below.

A transceiver adapted for receiving the antenna depicted in FIGS. 6–8 needs an antenna connector such as element 60 illustrated in FIG. 10. The FIG. 10 connector element includes a conducting female-threaded element 61 with solderable pin 65. Pin 65 is used to electrically and physically attach connector 60 to the circuit board within the transceiver. Associated with element 60 is an insulating element 62 that incorporates conducting, resilient, element 63 with a center opening that includes a pin 64. Pin 64 also protrudes from insulating element 62 and it, too, is used to physically attach connector 60 to the circuit board within the transceiver. In addition, it provides an electrical connection to element 63. Resilient element 63 is adapted to accept and slidably attach to conductor 154 of FIGS. 6–8.

The procedure for attaching the antenna of FIGS. 6–8 to connector 60 is quite simple. The antenna is guided into the antenna opening within a transceiver (not shown) and element 154 is pushed through the opening in resilient element 63 until the male threading of element 150 is engaged with the female threading of element 61. Thereafter, the antenna is threaded into element 60 in a conventional manner.

The FIG. 11 connector embodiment is designed to interact with the FIG. 9 antenna. FIG. 11 is identical to FIG. 10, except that insulating element 62 extends further than in FIG. 9 and includes a resilient element 65 with an output pin 66. When the antenna of FIG. 9 is in the collapsed form, conductor 154 protrudes maximally from element 150 and is coupled electrically to both element 63 and element 65. Conventional circuitry within the transceiver can be coupled to pins 64 and 66 to ascertain the fact that the two pins are shorted to each other via conductor 154. When the antenna is in its extended mode, element 154 is coupled electrically only to resilient element 63 and the short between pins 64 and 66 disappears. The conventional circuitry attached to pills 64 and 66 can be easily used to control operation of the transceiver, such as enabling the transceiver to transmit power only when a short does not exist between pins 64 and 66.

Even in the collapsed form shown in FIGS. 7 and 8, it is possible that some users might desire for the antenna to be collapsed still further so that the hand-held portable transceiver can be stored away (e.g., in a lady's pocketbook or a man's suit breastpocket). In accordance with this invention, a modified coupling means at the feed end of the antenna is provided that enables further "collapsing". This coupling means is depicted in FIG. 12, and the corresponding connector is shown in FIG. 13.

Figure 12:
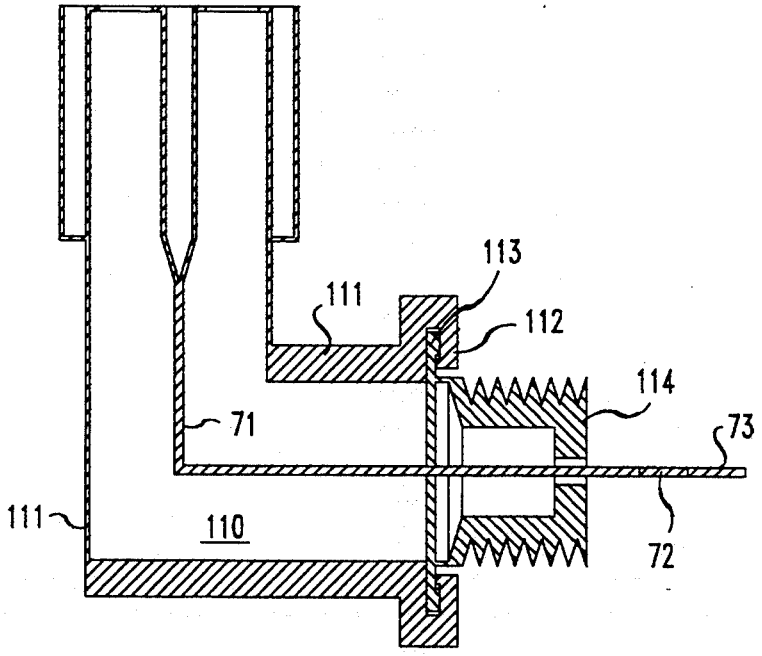
FIG. 12 depicts an arrangement that allows the FIG. 6 antenna to be rotated about a point in close proximity of the transceiver to which the antenna is connected.

More specifically, a structure that appears smaller is achieved in the FIG. 12 arrangement by providing means for pivoting the antenna. In its operational state, the antenna points upward as illustrated in FIG. 5. When the transceiver is stowed away, the antenna may be collapsed as shown in FIG. 7 and pivoted to point downward.

This is achieved, in the structure of FIG. 12, with a housing 110 that is generally shaped like an elbow. It provides means for rotating the antenna and a path for inner conductor 71 along its length, as it extends into the housing of the hand-held portable transceiver. More specifically, an outer wall 111 on housing 110 includes a hook portion 112 which is interconnected to a mating hook portion 113. Hook portion 113 is affixed to a male-threaded portion 114 which is threadably attachable to a hand-held transceiver. The interaction between hook portions 112 and 113 is such that the mating surfaces between the two portions are rotatable about their common axis.

Figure 13:
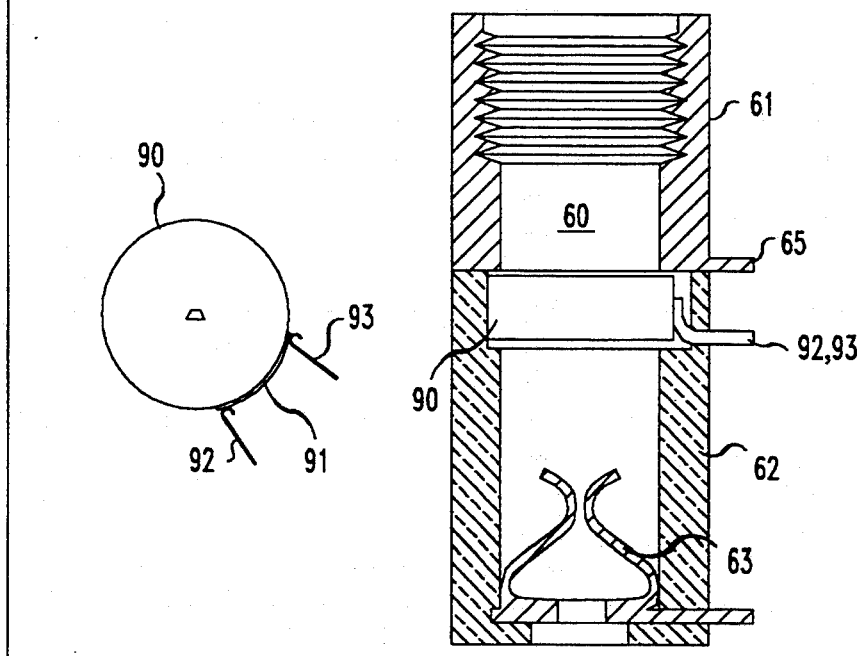
FIG. 13 illustrates a transceiver connector suitable for the FIG. 12 arrangement which includes means for detecting the antenna's orientation.

FIG. 13 illustrates one embodiment for a connector adapted for the coupling means shown in FIG. 12. As in the connector shown in FIG. 10, there is a conducting, female-threaded portion 61 with pin 65, and an insulating portion 62 that includes resilient metallic element 63 with a protruding pin 64. At the junction plane between elements 61 and 62 there is a cylindrical bore that houses a washer-like disk 90. The top view of this disk is illustrated on the left side of FIG. 13. Disk 90 is made of an insulating material, except that a narrow strip 91 of its perimeter is metallic. Resilient conductor segments 92 and 93 are arranged to make contact with strip 91 when the disk is properly oriented.

Metallic conductor 71 of FIG. 12 that protrudes from male-threaded coupler 114 includes a portion 73 with a circular cross-section followed by a portion with a trapezoidal cross section 72. Corresponding to trapezoidal portion 72, disk 90 includes a trapezoidal opening at its center.

In the course of assembly, portion 73 is pushed through the opening in resilient element 63 until trapezoidal portion 72 reaches disk 90. The antenna must then be rotated so as to fit portion 72 within the trapezoidal opening of disk 90. When that occurs, element 114 can then engage the threading in element 61 and the attachment of the antenna to connector 60 can proceed in a conventional manner. The FIG. 13 connector is arranged so to that contacts 92 and 93 are shorted to each other through strip 91 only when the antenna is in its upright position.

Some users might desire to have the more efficient operation of the antenna described herein, which results when the radiating portion of an antenna is displaced from a person's body, and at the same time be able to use an available half-wave sleeve dipole antenna such as one that may have been initially provided with the hand-held portable transceiver. In accordance with this invention, an antenna extender 160 is depicted in FIG. 14. This antenna extender comprises a coaxial element including an inner conductor 161 and an outer conductor 162. The extender also includes a choke element 163 attached to outer conductor 162 and is nominally $\lambda/4$ long at the frequency of operation.

Antenna extender 160 includes a threaded male connector 164 for connecting to a threaded female connector in a hand-held portable transceiver. It also includes a threaded female connector 165 for connecting thereto a half-wave sleeve dipole antenna. When the antenna extender is inserted between a half-wave sleeve dipole antenna and a hand-held portable transceiver, the advantageous operation of the structure described earlier herein, in connection with FIG. 4, is achieved in conformance with the principles of the invention.

A still another antenna structure is depicted in FIG. 15. Therein, antenna 180 comprises a first antenna element 182 that is connected to an inner conductor (not shown) of a first coaxial element 183. Element 182 is nominally λ/4 long. At one end of element 183, there is a sleeve element 184 that is also nominally λ/4 long. Below sleeve element 184 there is a coaxial line portion 185 having a length that is sufficiently long to minimize coupling between sleeve element 184, and a choke element 186 which is also λ/4 long.

A second coaxial element 186 connects the portable transceiver to the first antenna element 182. This coaxial element 186 includes a turn of approximately 90 degrees so that when the antenna is in its folded position, it aligns with the top and side of the portable transceiver. When extended, however, it rotates to a position wherein its radiating portion is displaced away from a person's body, achieving the desired advantageous operation.

Figure 16:
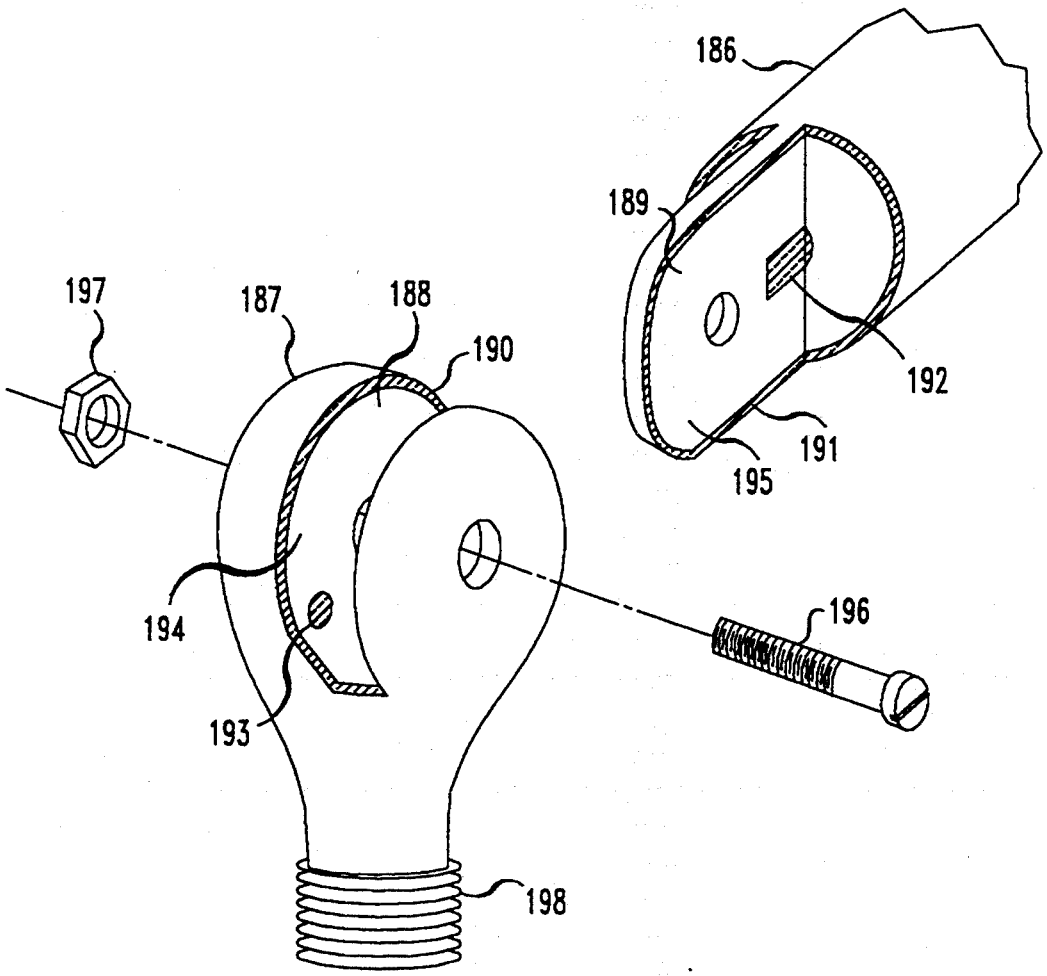
FIG. 16 illustrates a transceiver connector suitable for the FIG. 15 arrangement which includes means for detecting the antenna's orientation.

While providing for operation of the antenna 180, some users might desire for the antenna to include a switch to prevent transmission out of the antenna when it is in its folded position. This is achieved in the structure of FIG. 16 which not only facilitates rotation of the antenna, but also couples the desired switching action with the rotation.

Connector 187 includes a chamber 188 in which a fin-shaped section 189 of the coaxial element 186 is inserted. An outer ring of both sides of chamber 188 comprises conducting portions 190 for making electrical contact with conducting portions 191 on the perimeter of the fin-shaped section 189. In order for signals to be radiated by the antenna, a center conducting element 192 of coaxial element 186 is brought into engagement with a conducting element 193 on connector 187. These two elements are engaged only when the antenna is swung to a preselected position, which corresponds to the extended position of this antenna. Dielectric 194 isolates the conducting element 193 from the conducting portions 190 on the connector 187. Dielectric 195 isolates the center conducting element 192 from the conducting portions 191 of the coaxial element 186. A screw 196 projects through aligned openings on both the coaxial element 186 and the connector 187 for securing these two structures in a slidable friction-fit manner. A threaded male portion 198 is included on the end of the connector 187 for securing this connector to the hand-held portable transceiver.

We claim:

1. A device for use with a hand-held transceiver, said device comprising:

a hand-held transceiver sleeve dipole antenna having an inner conductor that extends beyond a dipole outer sleeve, where the dipole outer sleeve has an opening away from the extending inner conductor; and antenna radiation pattern enhancement means for positioning the hand-held transceiver sleeve dipole antenna, the radiation pattern enhancement means connected to said sleeve dipole antenna and having:

inner conducting means connected to the inner conductor of the sleeve dipole antenna, for delivering energy to, and receiving energy from, said inner conductor of the dipole antenna, outer conducting means connected to the dipole outer sleeve, and an outer conductor sleeve connected to the outer conducting means and having a central axis and an opening towards the opening of the dipole outer sleeve;

the inner conducting means and outer conducting means together comprising a single RF coaxial transmission line for feeding the sleeve dipole antenna with electromagnetic energy; and means coupled to said antenna radiation pattern enhancement means, for attaching the antenna radiation pattern enhancement means to a hand-held transceiver and for delivering energy to, and receiving energy from, the inner conducting means and the outer conducting means of the antenna radiation pattern enhancement means.

2. The device of claim 1 wherein the outer conductor sleeve is displaced a selected distance away from the dipole outer sleeve.

3. The device of claim 1 further comprising a hand-held transceiver attached to said means for attaching.

4. The device of claim 3 wherein said means for attaching comprises a threaded tubular element with a center opening that is physically and electrically part of the outer conductor of the antenna radiation pattern enhancement means, and a coupling conductor that is physically and electrically part of the inner conductor of the antenna radiation pattern enhancement means that extends through the center opening of the threaded tubular element.

5. The assembly of claim 1 wherein said sleeve dipole antenna is collapsible.

6. The assembly of claim 1 wherein the antenna radiation pattern enhancement means is collapsible.

7. The device of claim 1 wherein the means for attaching includes a center conductor and an outer conductor, such that the center conductor slides in relation to the outer conductor.

8. The assembly of claim 1 wherein the means for attaching includes two coupled elements that rotate in relation to each other about a common axis.

9. Apparatus for use with a hand-held transceiver and comprising:

a single coaxial transmission line section having a turn of approximately 90 degrees:

a choke section connected to the transmission line section;

a connector, coupled to the choke section and suitable for connection to a hand-held transceiver, the connector including rotation means and a switch element;

the transmission line section including a center conductor, and the switch element being adapted to allow signals to flow through the center conductor only when the transmission line section is swung, with the aid of the rotation means, to a preselected position.

* * * * *